United States Patent [19]

Bruce

[11] Patent Number: 4,470,953

[45] Date of Patent: Sep. 11, 1984

[54] PROCESS OF MANUFACTURING SINTERED METALLIC COMPACTS

[75] Inventor: Lars M. Bruce, Viken, Sweden

[73] Assignee: Uddeholms Aktiebolag, Sweden

[21] Appl. No.: 348,066

[22] PCT Filed: Jun. 10, 1981

[86] PCT No.: PCT/SE81/00172

§ 371 Date: Feb. 5, 1982

§ 102(e) Date: Feb. 5, 1982

[87] PCT Pub. No.: WO81/03634

PCT Pub. Date: Dec. 24, 1981

[30] Foreign Application Priority Data

Jun. 11, 1980 [SE] Sweden ..... 8004337

[51] Int. Cl.[3] ..... B22F 7/00

[52] U.S. Cl. ..... 419/6; 419/27; 419/30; 419/38; 419/40; 428/539.5; 428/547; 428/553

[58] Field of Search ..... 75/208 R, 211, 214, 75/226; 428/547, 548, 553, 539.5; 419/27, 6, 30, 38, 48, 40

[56] References Cited

U.S. PATENT DOCUMENTS

| | | | |
|---|---|---|---|
| 2,695,231 | 11/1954 | Causley | 75/208 R |
| 2,843,501 | 7/1958 | Ellis et al. | 419/27 |
| 2,979,401 | 4/1961 | Szymaszek | 419/40 |
| 3,697,261 | 10/1972 | Jump et al. | 75/208 R |
| 3,804,575 | 4/1974 | Chaudhok | 75/226 |
| 4,314,399 | 2/1982 | Severinsson | 75/229 |

FOREIGN PATENT DOCUMENTS

| | | | |
|---|---|---|---|
| 2518248 | 11/1976 | Fed. Rep. of Germany | 75/213 |
| 0718382 | 11/1954 | United Kingdom . | |
| 0751649 | 7/1956 | United Kingdom . | |
| 1268917 | 3/1972 | United Kingdom . | |

*Primary Examiner*—Benjamin R. Padgett
*Assistant Examiner*—Anne Brookes
*Attorney, Agent, or Firm*—Murray, Whisenhunt and Ferguson

[57] ABSTRACT

The object of the invention is a process of manufacturing a sintered compact of sinterable pulverulent material, in which the powder is moulded against a moulding surface and sintered in contact with the moulding surface and in which the pores in at least local areas of the compact are sealed by infiltration with an infiltration material which during a stage of the infiltration process is in liquid form and which by temperature decrease is caused to solidify in the pores, and the characteristic features of the invention are that the moulding takes place on the moulding surface in such a way that the moulding surface is covered with relatively fine-grained sinterable powder which by its own adhesion or by adhesion intensified by additives is caused to form an at least temporarily retained fine powder layer (3) on the moulding surface, and that at least one layer (5) of sinterable coarse powder is applied to the fine powder layer, and that both layers are sintered and infiltration is effected such that the infiltration material is caused by capillary action to be sucked from the coarse powder layer into the fine powder layer and through this layer towards the surface of the compact which is moulded by the moulding surface.

15 Claims, 3 Drawing Figures

PROCESS OF MANUFACTURING SINTERED METALLIC COMPACTS

Figure 1:
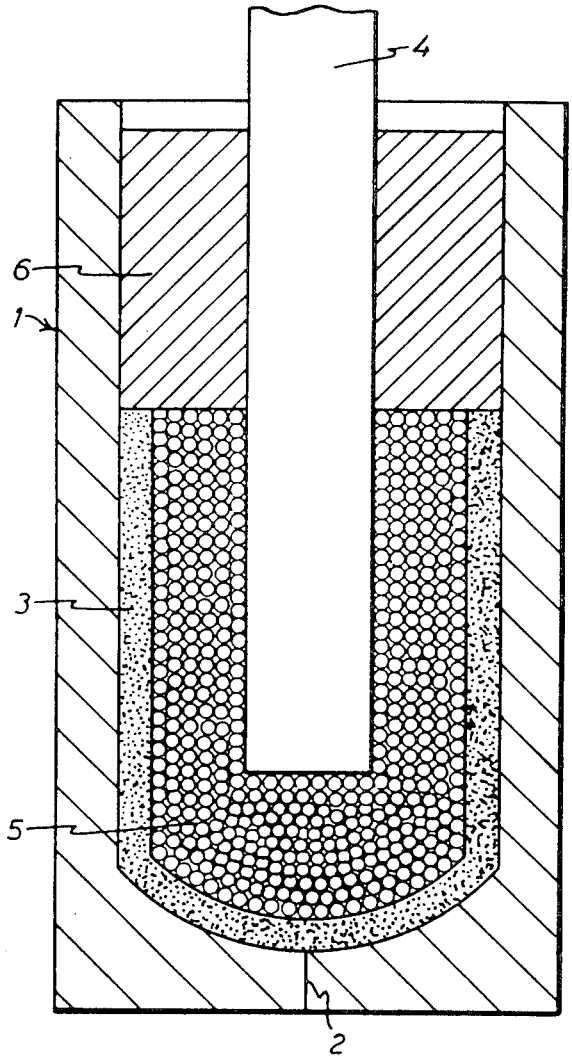

This invention relates to a process of manufacturing sintered metallic compacts from sinterable powder.

It is generally known to mould powder compacts from metal powder or metal powder mixtures and to increase the compactness of the powder mass to the desired density by vibration or pressing, for example isostatic pressing, and to sinter the compacts at a suitable sintering temperature. Infiltration of another metal having a lower melting temperature than that of the powder mixture can be effected in an infiltration step after sintering or during the sintering proper by means of an infiltrant metal supplied from outside, or by incorporating with the metal powder mixture a weighed amount of powder of infiltrant metal. In both cases the intention is to wet the metal powder grains and to fill the voids between them to provide a dense structure. The voids between the metal grains in the compact are interconnected by a network of fine passages, and the infiltration operation proper takes place by the intermediary of capillary forces.

In the mass production of sintered articles it is desirable to use metal powder mixtures which are as cheap as possible for the product quality one wishes to obtain. To attain as uniform an infiltration as possible of the infiltrant metal in the sintered metal powder compact it has been considered necessary to mould the metal powder compact from a mixture of powder particles which are of varying sizes and are well mixed with each other. However, even though the powder particles have been thoroughly mixed from the very beginning, the moulding and compaction of the metal powder mass may involve a tendency towards separation into coarse and fine grains with accumulations of finer grains among coarser gains. This tendency towards separation will become more pronounced when the powder mass is vibrated for compaction. The price of metal powder is dependent not only on the metal price itself but also on the screening accuracy. A metal powder of very narrow grain size distribution is more expensive than a metal powder of larger grain size distribution. It is generally considered that a very dense structure of a sintered product requires the product to be produced from very fine grains and pressing of the powder mass.

The use of powder mixtures of varying grain size is considered desirable in order that the interstices between coarse grains be filled with fine grains. Powder mixtures of varying grain size are considered advantageous in that a good compaction can be attained even at a moderate compaction pressure and that the screening accuracy can be reduced. However, the tendency towards separation and formation of finer and coarser local regions constitutes a problem.

A sintered compact prepared from a coarse-grained powder mixture may certainly display a relatively strong structure, but it is difficult to manufacture coarse-grained structures of good surface quality even if the structure is well filled with infiltration material. Moreover, a sintered compact displaying a structure of irregular distribution of fine and coarse grains, is of poorer quality than a sintered compact of uniform structure. This applies especially to sintered compacts which shall be subjected to machining or which shall for example have a uniform surface hardness, and a tendency towards separation into fine grains and coarse grains can therefore be devastating to product quality.

The invention has for its object to provide a process which permits manufacturing sintered compacts of very dense structure in the surfaces and in a layer, of desired thickness closest to the surfaces with the use of a sinterable powder which totally, i.e. for the entire sintered product, is relatively cheap and in many cases cheaper than a corresponding total amount of powder used for conventional manufacture of sintered compacts under equivalent requirements for quality. For the attainment of the last-mentioned object the present invention is based on the following theory.

If the structure of a sintered compact displays large or small "islands" of coarse powder grains among fine powder grains and vice versa, this is a result of local concentrations of fine grains in environments of coarse grains. The fine-grained "islands" relatively easily suck in infiltrant metal from the environment of coarse grains, while the "islands" of coarse grains show less capacity to suck in metal from an environment of fine grains. A coarse structure on the "dark side", that is downstream as seen in the infiltration direction, of a fine structure can therefore remain porous even after the infiltration because no infiltrant, metal has been sucked in from the fine structure.

On the other hand, a special problem arises at the sintering and infiltration steps. This problem manifests itself in such a way that infiltration material which has penetrated to the surface of a sintered compect, after sintering and infiltration, has a tendency to be sucked back into the compact because of a shrinking and suction phenomenon with a temperature decrease. the result thereof is that there are formed between the grains at the surface of the compact larger or smaller recesses with concave surfaces or even pitholes which can reach a greater or smaller depth. In coarse-grained structures the tendency of molten infiltration material being sucked in from the surface in such a manner will be very pronounced and may even result in the formation of craters or so-called suction holes of greater or smaller depth, but this tendency decreases with diminishing grain size. This speaks for the use of as small a grain size as possible. At an average grain size of about 250 μm and more the formation of areas free of infiltration material or a deficient infiltration in local regions becomes very pronounced, which also applies to the formation of recesses, craters and suction holes in the surface. At an average grain size of about 200 μm and less it is generally possible to realize a good structural density by infiltration, but if the average grain size is reduced considerably below 150 μm problems will be encountered, involving shrinking (settling) of the mass of grains as molten infiltration material is sucked in. These considerations speak for the use of an average grain size of between about 150 and about 200 μm.

As mentioned in the foregoing, a certain irregular inner structure may well be tolerated in many products, whereas an irregular surface structure may result in that the product being unacceptable. This especially applies to products in which great importance is attached to their outward appearance, but structural defects in a layer inside of the surface may also be devastating, which applies for example to products which shall be surface treated or for instance ground. By way of example, mention may be made of the manufacture of sintered tools which are to be ground for use in cutting operations.

With regard to sintered products it is often required that the inner material of the product shall possess other strength properties than the surface and the layer closest to the surface. It may for example be desired for the product to have a hard non-porous surface layer and a tough core of great resistance to rupture.

The primary object of the present invention is to provide a process which removes or substantially eliminates all of the problems outlined above for the manufacture of relatively cheap sintered products of good quality and especially fine, dense and non-porous surface structure and strong inner structure.

Another important object of the invention is to provide a process which permits manufacturing sintered compacts having as non-porous a structure as possible of the surface and the surface layer and different strength properties of the material in the surface layer of the compact and the interior thereof.

These objects have now been attained by imparting to the process according to the invention the characteristic features defined below.

Figure 2:
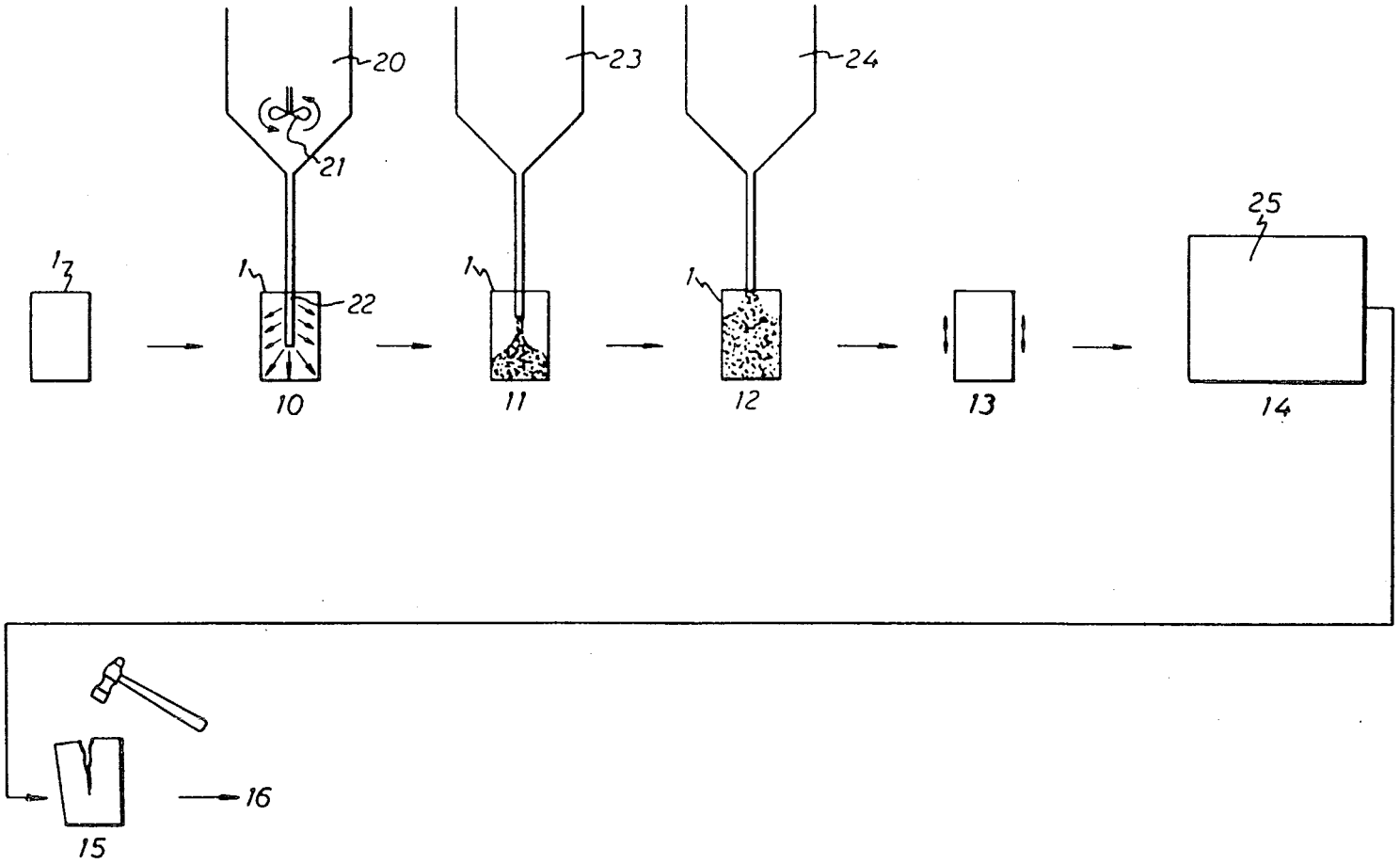
Figure 3:
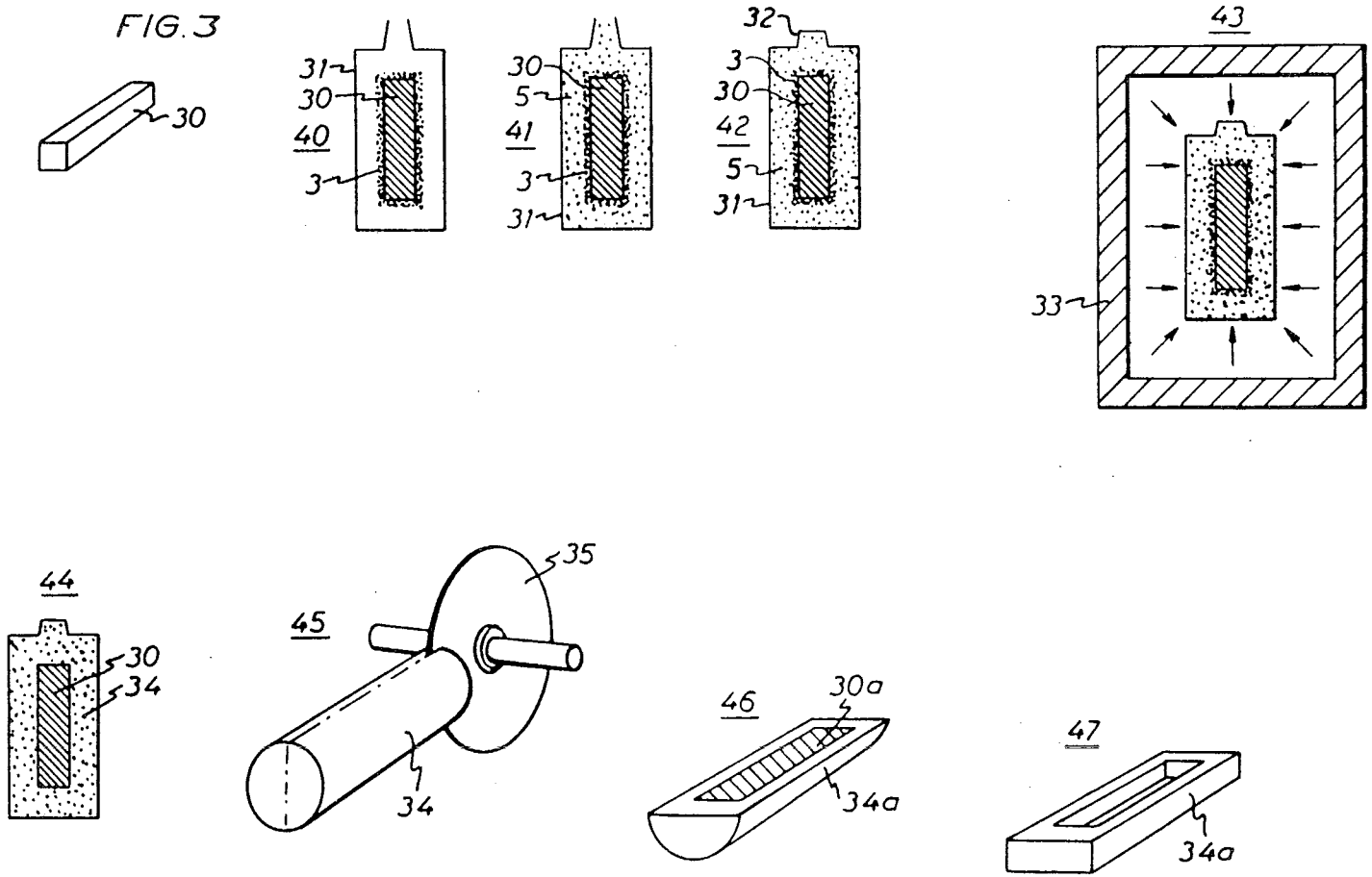

The invention will be described in greater detail in the following with reference to the accompanying drawings which for purposes of simplification are in diagrammatic form and in which FIG. 1, in longitudinal section, shows a mould filled with metal powder according to the invention for the manufacture of a sintered metal powder compact sealed by means of infiltration material;

FIG. 2 shows a production line for the manufacture of sintered metal powder compacts according to the invention sealed by means of infiltration material; and FIG. 3 shows a production line for the manufacture of sintered tools according to the invention by hot isostatic pressing in hermetically closed moulds.

FIG. 1 shows a mould 1 which for example consists of hard-sintered ceramic material, quartz or other heat-resistant material for the manufacture of a sintered compact of desired shape. The mould in FIG. 1 is illustrated for the sake of simplicity as an uncomplicated mould for the manufacture of a hollow body, said mould being divisible along a line of division 2. It should be observed however that it is possible according to the method of manufacture described in the following to manufacture moulded bodies of very varying shapes and that the invention is not bound either to the shapes or uses of products manufactured according to the invention.

A layer 3 of a fine powder of metal or other sinterable metallic material, such as carbide, or ceramic material is applied, from the upper side of the mould which in FIG. 1 is closed at the bottom, in such a way that the fine powder layer 3 is consolidated and retained in the mould at the inner side thereof. If, as in the case illustrated, a hollow body is to be manufactured, a suitable core 4 is inserted in the mould and then there is supplied to the hollow space between the outer layer 3 and the core 4 a metal powder or metal powder mixture 5 of larger particle size than that of the outer layer 3 which surrounds the coarse powder as a fine-grained jacket.

The coarse powder in the interior of the mould may consist for example of steel powder or a mixture for the manufacture of an inner wall of steel, while the outer layer may consist of metal powder of the same type, but of smaller particle size. However, said outer layer may also consist of another type of metal or metal alloy or of a sinterable metallic or ceramic material depending upon the use of the product manufactured. It is assumed in this embodiment that the surface layer consists of a fine-grained tool steel type steel powder for the manufacture of say a milling tool. The inner side of the mould 1, to which the surface layer is applied, should then have a shape complementary of the milling tool in question so that for the final shaping of the sintered product there is in principle only required a grinding operation for producing the cutting surfaces. In another case, the surface layer may consist of say molybdenum or carbide powder for the manufacture of a very wear-resistant or hard surface layer. The powder, say carbide powder, may include hard grains, such as diamond grains, if the product is a tool to be used for grinding. The coarse powder in the centre of the compact may for instance consist of steel powder or a powder based on iron with a content of carbon powder and powder of alloy elements for the manufacture of a steel core of suitable physical properties, such as strength and toughness. At the manufacture of tools for cutting operations use can be made according to the invention of a relatively small amount of high-quality and relatively expensive tool steel for the surface layer, and for the inner core portion of the tool use can be made of a coarse powder of the same or another kind of steel which gives the tool the requisite strength and toughness.

Hollow articles having an inner surface layer similar to the described outer surface layer 3 can also be manufactured. To this end, a surface layer of fine-grained powder may be applied to a mould core, such as the core 4, and then a body of more coarse-grained powder is built up about said fine-grained powder. In this way it is also possible to manufacture for example relatively cheap, but strong tubular articles, such as extrusion dies, engine nozzles or wire drawing dies, bearing rings, gear wheels, rolls for various purposes, plungers, cylinders or cylinder liners, to cite but a few examples. Hollow articles having both inner and other layers of fine-grained material and intermediate material of coarser cheaper powder can of course also be manufactured.

For the manufacture of relatively thick surface layers, say 1 mm or more, the fine-grained powder may be packed against the inner side of the mould, for instance by inserting in the centre of the mould a steel tube of smooth outer diameter, which is smaller than the mould cavity and defines an interstice in relation to the inner side of the mould. This interstice can be filled with the fine-grained powder and the powder can be successively packed in said interstice from the bottom of the mould upwards by means of a annular plunger so that the fine-grained powder forms a stabilized jacket, after which the tube is withdrawn. In the jacket 3 formed by fine powder or, as in FIG. 1, the interstice between the inner side of the jacket 3 and the mould core 4 the coarser powder mixture 5 is then applied and suitably packed. The packing operation for compaction of the powder 5 can be performed for instance by means of an annular plunger successively from below in an upward direction at the same time as the above-mentioned steel tube is pulled upwards. Another way is to rotate the mould at a very high speed to subject the powder to centrifugal forces.

For the manufacture of relatively stable, thin surface layers of fine-grained powder, say thicknesses of from some millimeter or millimeters and say down to some tens of a μm, a slurry of fine-grained powder instead of a dry powder can be applied to the respective mould surface. As a wetting agent for the slurry use can be made of alcohol or another suitable hydrocarbon which does not deteriorate the properties of the metal powder after sintering. Hydrocarbon is suitable in that it has a reducing effect to some extent and certain hydrocarbons can form a binder for the powder, which can be expelled by heat. The expulsion of hydrocarbon vapours is facilitated by the use of a mould 1 of ceramics, which absorbs or permits the vapours to pass.

FIG. 1 shows a layer 6 of infiltration material which has been applied in the mould 1 onto the powder layer 3, 5 and which has been selected with due regard to the type of powder used. For iron-based powders it is recommended to use infiltration material based on copper or mixtures, such as nickel and tin, with or without additions of other substances and of lower melting point than that of the powder material 3, 5.

By melting the infiltration material 6 into the powder compact 3, 5 in connection with or after the sintering operation or during a stage thereof the molten infiltration material is sucked into the pores of the compact. The compact consisting of coarse powder is relatively rapidly filled up with infiltration material.

If for the reasons indicated in the introduction certain pores or pore accumulations in the coarse-grained structure 5 are "shadowed" by accumulations of fine grains, these can be left unfilled. From the relatively coarse-grained structure 5, however, infiltration material is sucked by capillary action into the fine-grained surface layer structure 3 with very good effect. As mentioned in the introduction, the capillary action would in fact seem to increase from a coarse-grained structure towards a fine-grained one, and if the fine-grained layer is of relatively small thickness, a very good uniform filling of infiltration material is obtained in the pores of the fine-grained surface layer structure to the very surface thereof. It should be observed that the difficulty of building up a surface layer 3 of sufficient stability in order that it will not collapse during the continued treatment of the powder compact 3, 5 (building up of an inner powder mass 5 and compaction), generally decreases with decreasing powder grain size and increases with increasing thickness of the layer 3, and that the potential thickness of the layer 3 may be limited for that reason.

It amounts to a great advantage that the inner coarse-grained structure 5 operates as a filter, filtering away impurities such as slag-forming substances, if the infiltration metal before penetrating into the fine-grained structure is forced to pass through the coarse-grained structure. Therefore the fine-grained structure will be substantially entirely tight and free of foreign substances.

After the sintering and infiltrating operation and the requisite cooling the mould compact is removed in some known way from the outer mould 1 and the mould core 4.

In FIG. 2, 1 designates a mould which is conveyed for instance on a conveyor belt (not shown) and in a closed protective gas atmosphere, along a production line comprising a first station 10 where the mould 1 is stopped beneath an apparatus 20 from which a slurry of fine powder is sprayed through a nozzle 22 onto the inner side of the mould 1 or onto the surface or surfaces of the mould or a mould core to be coated with a surface layer of fine powder. The powder slurry can be kept agitated in the apparatus 20 by means of an agitator 21 and sprayed by gas under pressure (inert gas) or by means of a plunger through the nozzle 22. From the station 10 the mould 1 is transferred to a subsequent station 11 where a base powder mixture, i.e. the powder which is to form the coarse powder structure of the powder compact, e.g. the central core portion of the powder compact, is introduced into the mould 1 by a dispenser 23. From the station 11 the mould 1 is transferred to a third station 12 where a suitable infiltration material is introduced by means of an apparatus 24 into the mould over the powder compact moulded in stations 10 and 11, and from the station 12 the mould 1 is transferred with its contents of powder and infiltration material to a station 13 in which the powder is compacted in a suitable manner, i.e. by rotation or pressure, say isostatic pressing. It should be observed that the station 13 may alternatively be placed between the stations 11 and 12. From the station 13 (or alternatively from the station 12) the mould with its contents is transferred to a station 14 consisting of a sintering furnace 25 in which sintering of the metal powder and at the same time infiltration of the sintered compact is performed. Alternatively, the station 12 may follow after or be associated with the station 14 and may consist of a hot isostatic press. From the station 14 the mould with the sintered compact is transferred to a station 15 which the sintered compact is released from the mould, e.g. by division of the mould or otherwise, and finally the sintered compact can be transferred to a post-treatment station 16 in which for example hardening, grinding, forging or other treatment is performed.

Practising the process according to the invention it is in many cases possible to vibrate the mould for compaction, without demolishing the surface layer of fine-grained powder. If the fine-grained layer is of suitable thickness and has a sufficient support from the base powder mixture (the coarse powder mixture) or otherwise has sufficient layer stability to withstand vibration without collapsing, the vibrating operation may provide the effect that the coarse and the fine powder in the interface between the two powder fractions are superficially mixed with each other, which may be of advantage to avoid sharp boundaries between layers. The same effect can be obtained by consolidation of the powder by pressing. If hot isostatic pressing is desired, said pressing operation can be carried out in the sintering furnace 25.

After the introduction of the powder mixtures and the infiltration material into the mould said mould can be hermetically closed and subjected to isostatic pressing. For this purpose use should be made of a mould which is sufficiently flexible for the isostatic pressing. Moulds of say steel or glass display the desired properties to permit isostatic pressing at very high pressures and the desired temperature.

For the manufacture of many products, e.g. preformed blanks for cutting tools, use can be made of a cylindrical mould with a convenient press plunger. The inner side of the cylindrical mould or desired local areas of the inner side are coated with fine-grained metal powder of a suitable cutting steel alloy, after which the space is filled with coarse powder of suitable quality to form the core material of the tool. The powder is pressed to high density by means of the plunger, and at the same time the mould with the powder can be heated to a plastic state. By reason of the pressing and heat-treating operation a certain infiltration is brought about in that the plastic powder in the centre of the mould is pressed peripherally outwards by the mechanical pressure.

As already mentioned, the fine powder layer may consist of a high-quality tool steel alloy, but could also consist of say carbide for blanks intended for cutting tools, while the core could consist of a coarse high-speed steel powder. For other blanks, e.g. blanks to be used as rolls, the outer fine powder layer and the core of coarser powder may consist of the same type of material, but it is possible to manufacture for example rolls with stainless jackets from fine powder of stainless steel, while a cheaper powder is utilized for the core.

According to the invention it is also possible to manufacture tubes having a dense, smooth inner side. In such manufacture use can be made of a cylindrical mould having a rod-shaped, preferably movable core and an annular powder pressing plunger. An inner surface layer of fine-grained powder is applied to the core and possibly to the inner side of the cylinder, and a cheaper, coarse powder is introduced therebetween and packed longitudinally of the mould. Compaction can be realized by centrifugation and/or by means of an annular plunger. Building up of the tubular wall can take place successively by displacement of the built-up powder wall and an open-ended cylinder in relation to one another, and optionally the powder may be heated to a plastic state. It is also possible to effect successive sintering of the tube wall emerging from the cylinder, whereby large tube lengths or even continuous manufacture of tubes may be realized. Sealing of the tube wall can be performed by means of a suitable infiltration material which need not consist of metal but for instance enamel slip or teflon. For stabilization of the powder (also the coarse-grained powder), particularly in connection with successive sintering according to the above description, use can be made of for example a binder such as cellulose or starch or any other suitable binder whatever. By selection of binders oxide occlusions or carbonization may be reduced to a certain extent. In this way it is possible to manufacture strong tubes of desired wall thickness and inner diameter from very coarse cheap tubes for installations of various kinds to very fine tubes from which, as already mentioned, there may be manufactured for instance spraying nozzles, e.g. for chemicals, fuels, extrusion etc.

FIG. 3 diagrammatically shows a production line for the manufacture of hot isostatically pressed metal powder compacts according to the invention, in which case the sintering furnace may optionally be replaced by a hot isostatic press.

A pattern 30 is transferred to a station 40 where it is placed in a container 31 of steel or other flexible or elastic material suitable for isostatic pressing. In the manner already described, a fine powder layer 3 is applied to the surface of the pattern 30 before or after the placing thereof. In the same station or in a subsequent station 41 a powder mass 5 is introduced, which may consist of coarse or cheap powder, around the pattern 30 and its fine powder layer 3. Then air and gases are evacuated in a special station 42 or the preceding station 40 or 41 and the container is hermetically closed at 32. The hermetically closed container 31 with its contents is transferred to a station 43 comprising a hot isostatic press 33 in which sintering is effected under heat and high pressure.

From the isostatic press in the station 43 the container with its content is transferred to a station 44 in which the container is separated from the sintered compact 34. Then the sintered compact 34 and the pattern are divided by means of a dividing apparatus, such as a cutting disc 35 or e.g. a laser beam, in a station 45, whereupon the pattern halves, such as the pattern half **30*b* illustrated in station 46, are removed from the respective mould halves 34*a*. If necessary, the mould halves can then be surface milled in the plane of division in a station 47**, simultaneously as compensation, if any, for dimensional changes during the manufacturing process and the division may be effected.

Infiltration can advantageously be carried out in a furnace between stations 44 and 45 or in a furnace before or after station 47, but it is also possible to incorporate with the powder 5 in station 41 a pulverulent infiltration material that is infiltrated in station 43.

The division in station 45 can be effected in a suitable plane of division, which has been predetermined with due regard to the pattern 30, or, if necessary, in several planes of division.

Tools or moulds of e.g. steel, which are manufactured in accordance with the invention can be used for the same purpose as conventionally manufactured steel tools or steel moulds and can be hardened.

It is realized from the above description that the mould 1 and/or the core 4 in FIG. 1 may be considered to constitute a pattern or moulding surface which serves to impart the desired shape to the powder compact 3, 5. The surface of the mould 1 and the core 4 (if the latter is not to be incorporated with the product) shall permit separation of the mould and the core, respectively, from the sintered compact without damage to the surfaces thereof. Such a separation without damage may necessitate the use of a mould releasing agent or, optionally, crushing or other destruction of the mould 1 and/or the core 4. Methods facilitating the separation of a mould from a sintered compact are prior art and therefore not described here. It should further be observed that the invention is also applicable to processes in which more than one layer of relatively fine powder are applied to the moulding surface in question, the size of the powder particles in the various layers increasing in the direction away from the moulding surface.

For the coarse powder layer 5 there may be used, without any infiltration problems for the fine powder layer 3, powders having an average particle size of 250 μm or more, while for the fine powder layer 3 use should be made of an average particle size which does not exceed 150 μm and may be considerably smaller, in which case the maximum particle size should be several times smaller than the fine layer thickness and should at least not be greater than half the fine layer thickness.

The invention is not restricted to the embodiments described above, but may be modified in various ways within the scope of the appended claims.

I claim:

1. In a process of manufacturing a compact of sinterable powder material wherein the sinterable powder is moulded and compacted against a moulding surface and in which the pores of the compact are sealed by infiltration of a material which is in liquid state or during a stage of the infiltration process is brought to the liquid state for the infiltration and is then caused to solidify in situ, the improvement comprising covering the moulding surface with a fine-grained sinterable powder which forms a fine powder layer and which is at least temporarily retained on the moulding surface and wherein the fine-grained sinterable powder of the fine powder layer is selected from a powder having an average particle size which does not exceed 150 μm and the average particle size is also less than half the thickness of the fine powder layer, applying at least one layer of coarse sinterable powder to the fine powder layer such that the side of the fine powder layer facing the moulding surface is moulded by the moulding surface and the said two layers are compacted, interconnecting said two powder layers, melting an infiltration material, the bulk of which is not initially mixed with either of said two powder layers, to infiltrate said coarse powder layer such that the compact of the coarse powder layer is filled with the infiltration material, and part of the infiltration material is caused to contact the mould surface by capillary action of the fine powder layer such that in the compact of the fine powder layer a uniform filling of infiltration material is obtained in the pores thereof at the surface thereof facing the moulding surface and on the moulding surface, and solidifying the infiltration material while still in contact with the moulding surface such that the pores of the moulding surface structure of the fine powder layer compact are filled with infiltration material.

2. A process as claimed in claim 1, wherein to build up the fine powder layer there is applied to the moulding surface, at least as an initial film of the layer, fine powder suspended in or wetted with a wetting agent.

3. A process as claimed in claim 1, wherein the fine powder layer is built up on an inner circumferential surface of a hollow mould so that there remains a hollow space in the mould inside of the fine powder layer, and that the hollow space is filled with the coarse powder for the formation of a core of coarse powder, surrounded by the fine powder layer.

4. A process as claimed in claim 1, wherein the fine powder layer is built up on a moulding surface consisting of a mould core disposed in an outer mould, and that coarse powder is arranged around the fine powder layer on the mould core so that said coarse powder is caused to fill out an interstice between the fine powder layer and the inner circumferential surface of the mould.

5. A process as claimed in claim 1, wherein the coarse sinterable powder is pressed or otherwise packed against the fine powder layer so that pressure forces generated by the packing are caused to act with at least one main component substantially perpendicularly to the surface of the fine powder layer to press or hold the last-mentioned layer against the moulding surface are to prevent the fine powder layer moulded by the moulding surface from collapsing before it is stabilized by the sintering operation.

6. A process as claimed in claim 5, wherein the pressing or packing of the coarse powder against the fine powder layer is performed such that sharp layer interfaces are eliminated.

7. A process as claimed in claim 1, wherein hollow articles having an inner and/or outer fine powder layer and a jacket and/or core of the coarse powder are manufactured.

8. A process as claimed in claim 1 for the manufacture of tubular articles, wherein a layer of the fine-grained powder is applied to a cylindrical mandrel, that a jacket is formed from the coarse powder on said layer and that the mandrel with the fine powder layer and the jacket of coarse powder are placed in sintering furnace and sintered, infiltration being performed so that the infiltration material is introduced into the article through the jacket to the inner fine powder layer.

9. A process as claimed in claim 8, wherein the moulding of the inner fine powder layer and the outer jacket of coarse powder is performed in a moulding station on a mandrel movable in the axial direction through the moulding station, that the sintering is effected while the core with the fine powder layer and the jacket is successively conveyed through the sintering furnace and that the infiltration is carried out simultaneously with the sintering or immediately after the sintering, while the material still has a sufficiently high temperature.

10. A process as claimed in claim 9, wherein the moulding and sintering operation is carried out in vacuum or in a protective or reducing gas atmosphere.

11. A process as claimed in claim 1, wherein a majority of the said powder of the compact is the coarse sinterable powder and a thin layer of the fine-grained sinterable powder is disposed on the moulding surface.

12. A process as claimed in claim 1, wherein the fine-grained sinterable powder is a powder which imparts hardness to the fine powder layer and the coarse sinterable powder is a powder which imparts other desired physical properties to the compact.

13. A process as claimed in claim 12, wherein the fine-grained powder comprises hard abrasive particles.

14. A process as claimed in claim 12, wherein forming or cutting tool blanks are produced with hard surface layers composed of of fine sinterable powder produced from tool steel or metal carbide and a compact of coarse sinterable powder.

15. A process as claimed in claim 1 for the manufacture of an article in the form of a forming tool, wherein at least one layer of the fine powder layer is applied to a pattern, the pattern before or after application of the said at least one fine powder layer is placed and fixed in a vessel such that there is an interstice between said at least one fine powder layer and the inside if the vessel, the interstice is filled with the said coarse sinterable powder, the vessel is placed in an isostatic press and the said powders are pressed into a compact of desired density, the compact is sintered and said infiltration material is melted and caused to contact and be moulded by said pattern, the vessel is divided along at least one predetermined plane of division and the pattern is removed from the sintered compact.

* * * * *